United States Patent [19]

Takeda

[11] 3,938,489

[45] Feb. 17, 1976

[54] IGNITION SYSTEM FOR TWO-CYLINDER ENGINES

[75] Inventor: Yoshiaki Takeda, Nagoya, Japan

[73] Assignee: Nippondenso Co., Ltd., Kariya, Japan

[22] Filed: Nov. 15, 1973

[21] Appl. No.: 416,279

Related U.S. Application Data

[63] Continuation-in-part of Ser. No. 382,112, July 4, 1972, abandoned.

[30] Foreign Application Priority Data

July 31, 1972 Japan ..... 47-77158

[52] U.S. Cl...... 123/148 DS; 123/8.09; 123/148 C; 123/148 E; 200/25; 200/27 A

[51] Int. Cl.[2].. F02P 7/10; F02P 15/02; F02B 53/12

[58] Field of Search..... 123/8.09, 148 DS, 148 C, 123/148 E; 200/25, 27 A

[56] References Cited

UNITED STATES PATENTS

| | | | |
|---|---|---|---|
| 1,659,773 | 2/1928 | Helle | 123/148 C |
| 2,285,107 | 6/1942 | Bohli | 123/148 C |
| 3,250,867 | 5/1966 | Short | 123/148 DC X |
| 3,554,092 | 1/1971 | Shibagaki | 123/148 DS X |
| 3,716,991 | 2/1973 | Tatsutomi et al. | 123/148 DS X |
| 3,735,739 | 5/1973 | Panhard | 123/148 DS X |

*Primary Examiner*—Wendell E. Burns
*Assistant Examiner*—Tony Argenbright
*Attorney, Agent, or Firm*—Cushman, Darby & Cushman

[57] ABSTRACT

An ignition system for a two-cylinder engine is provided which comprises two ignition signal generators, two ignition coils and two spark plugs for each of the cylinders. The first ignition signal generator controls the first ignition coil and two of the spark plugs are connected in series with the first ignition coil. The second ignition signal generator controls the second ignition coil. The second ignition coil is connected in series with the other two spark plugs. The first and second ignition signal generators operate independently of each other and generate their ignition signals at different time instants. And, of the two spark plugs provided for each cylinder, one is a main spark plug and the other is a combustion promoting spark plug. The main spark plugs are simultaneously controlled by the first ignition signal generator and either one of two combustion promoting spark plugs is controlled, with a time delay, by the second ignition signal generator.

7 Claims, 8 Drawing Figures

IGNITION SYSTEM FOR TWO-CYLINDER ENGINES

CROSS REFERENCE TO RELATED APPLICATION

This application is a continuation-in-part of application Ser. No. 382,112 filed on July 24, 1973 now abandoned.

The present invention relates to an ignition system for a rotary engine.

Rotary engines used in automotive vehicles are mainly of the two-rotor type (two-cylinder type) and moreover it has been customary to provide two spark plugs for each of the rotors in order to ensure an improved starting performance.

In the past, rotary engine ignition systems of this type have been usually provided with two distributors and two ignition coils to distribute the required ignition sparks to the four spark plugs and therefore they have the disadvantages of the entire ignition system becoming large in size and inconvenient servicing of the ignition system.

For this reason, in order to reduce the number of distributor units to one, one approach may be conceived in which two circuit breakers controlled by a common cam are disposed in the same plane within the distributor unit, whereby the two circuit breakers simultaneously produce the spark voltage in the two ignition coils so that the spark voltage produced in one of the ignition coils is applied to one spark plugs of the respective cylinders by the distributor and the spark voltage produced in the other ignition coil is applied to the other spark plugs of the respective cylinders which are connected in series with the other ignition coil. A drawback of this approach is that the atmospheric condition of the mixture in the vicinity of the location of one spark plug differs completely from that of the other spark plug in each cylinder with the result that the ignition quality of either one of the spark plugs is deteriorated causing the engine to fail to give the maximum power output and also giving rise to the emission of noxious exhaust gases.

The foregoing difficulties are overcome by the ignition system of this invention wherein two ignition signal generators adapted to operate independently of each other and generate ignition signals at different time instants with respect to each other, are arranged on the axis of a distributor assembly, whereby two ignition coils are controlled respectively by the two ignition signal generators to produce therein the spark voltages at different time instants with respect to each other.

In accordance with the present invention, the ignition system comprises a distributor assembly having arranged on the same axis thereof two ignition signal generators adapted to operate independently of each other and generate the ignition signals at different time instants with respect to each other whereby two ignition coils are controlled respectively by the two ignition signal generators to produce therein the spark voltages at different instants with respect to each other, and there is thus a remarkable advantage of applying the spark voltages to the two spark plugs provided for each cylinder at correct ignition instants and thus ensuring improved engine performance.

Figure 1:
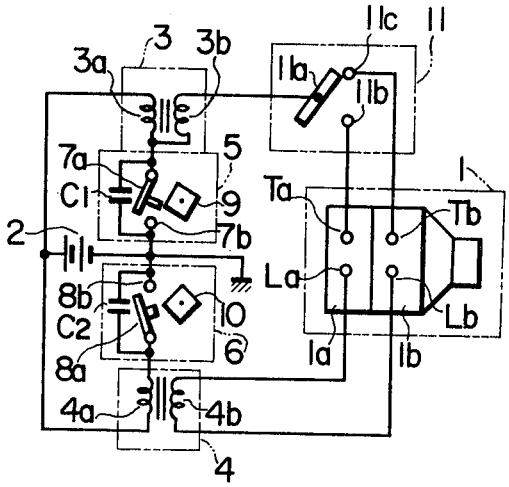
FIG. 1 is an electric circuit diagram showing an embodiment of a two-cylinder engine ignition system according to the present invention.

The present invention will be described in greater detail with reference to the illustrated embodiment. Referring first to FIG. 1, numeral 1 designates a rotary engine comprising two cylinders 1*a* and 1*b*. The cylinder 1*a* is provided with two spark plugs T*a* and L*a*, while the cylinder 1*b* is provided with spark plugs T*b* and L*b*. Numeral 2 designates a battery having its positive terminal connected to primary windings 3*a* and 4*a* of ignition coils 3 and 4, respectively. The other ends of the primary windings 3*a* and 4*a* are connected respectively to breaker arms or movable arms 7*a* and 8*a* of circuit breakers 5 and 6 whose stationary contacts 7*b* and 8*b* are connected to the negative terminal of the battery 2 and are also grounded. Numerals 9 and 10 designate distributor assembly shafts which rotate in association with the engine 1, $C_1$ and $C_2$ are suppressing capacitors with the capacitor $C_1$ connected in parallel with the breaker arm 7 *a* and the stationary contact 7*b*, and the capacitor $C_2$ connected in parallel with the breaker arm 8*a* and the stationary contact 8*b*. Of secondary windings 3*b* and 4*b* of the ignition coils 3 and 4, the secondary winding 3*b* has its one end connected to the other end of the primary winding 3*a* and the other end connected to the spark plugs T*a* and T*b* by way of a distributor brush 11*a* of a distributor 11 and segments or side electrodes 11*b* and 11*c*, respectively, and the other secondary winding 4*b* is connected in series with the spark plugs L*a* and L*b*.

Figure 2:
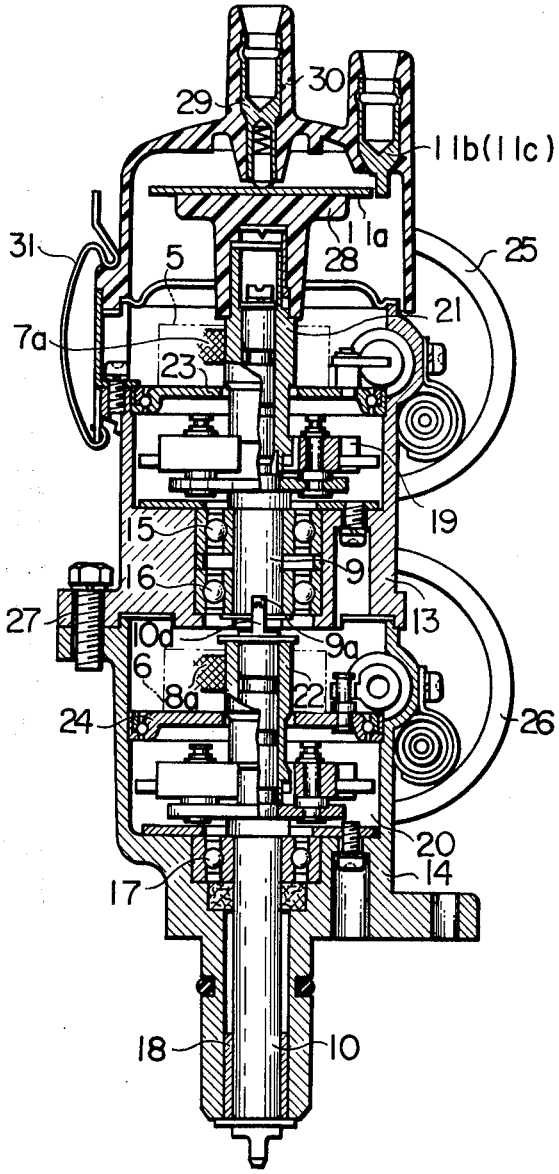
FIG. 2 is a longitudinal sectional view of the distributor assembly used with the system of FIG. 1.

Referring now to FIG. 2, the mechanical construction of the distributor assembly comprising the circuit breakers 5 and 6 and the distributor 11 will be described.

The two distributor assembly shafts 9 and 10 are integrally connected together by means of a recess 9*a* formed at the lower end of the shaft 9 and a projection 10*a* formed at the upper end of the shaft 10, and the shafts 9 and 10 are rotatably supported respectively by bearings 15, 16 and 17, 18 within housings 13 and 14, respectively. Mounted respectively on the distributor shafts 9 and 10 are centrifugal advance mechanisms 19 and 20 whose cams 21 and 22 are movably fit respectively on the distributor shafts 9 and 10 to actuate respectively the breaker arms 7*a* and 8*a* of the circuit breakers 5 and 6. Vacuum-advance devices 25 and 26 are connected respectively to movable plates 23 and 24 having respectively the circuit breakers 5 and 6 mounted thereon, so that the movable plates 23 and 24 may be moved and displaced with respect to the cams 21 and 22 in proportion to the amount of vacuum in the intake manifold of the engine. The housings 13 and 14 are joined together with fastening screws 27.

A distributor rotor 28 having the distributor brush 11*a* is mounted on the cam 21, and detachably mounted on the housing 13 by a clamp 31 is a distributor cap 30 which comprises the side electrodes 11*b* and 11*c* disposed to face the distributor brush 11*a* and a center electrode 29 which supplies the spark voltage generated in the secondary winding 3*b* of the ignition coil 3 to the distributor brush 11*a*.

Figure 3:
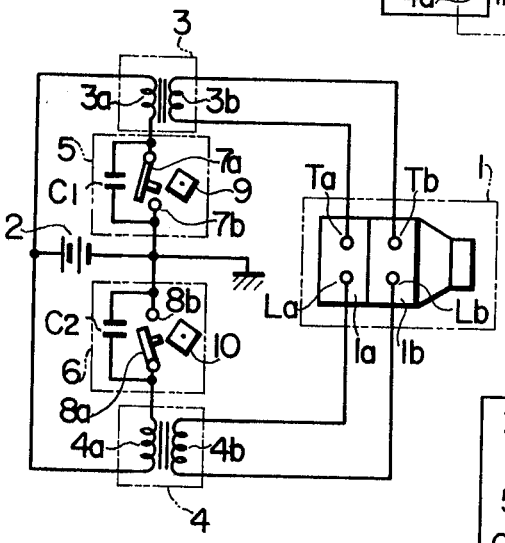
FIGS. 3, 4 and 5 are electric circuit diagrams showing a second, third and fourth embodiment respectively according to the present invention.

A second embodiment shown in FIG. 3 shows a circuit diagram without a distributor in comparison with the above first embodiment and the other elements of the construction are all the same as in FIG. 1.

Figure 4:
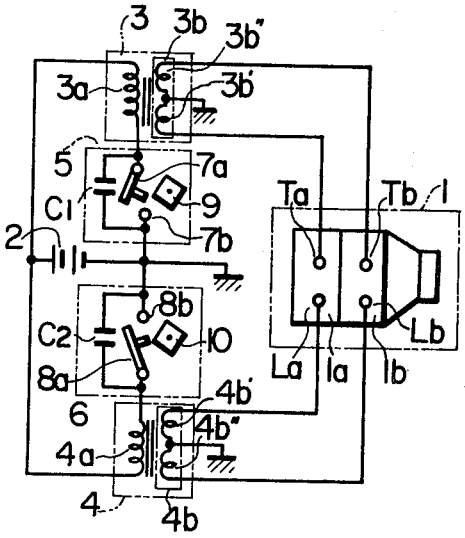

A third embodiment shown in FIG. 4 differs from only a connection of ignition coils 3 and 4 in comparison with the above second embodiment. That is, ignition coils 3 and 4 comprise secondary windings 3*b* and 4*b* consisted of two coil members 3*b*' and 3*b*''; 4*b*' and 4*b*'' whose common taps are grounded and spark plugs T*a* and T*b*; L*a* and L*b* are connected to the coil members 3*b*' and 3*b*''; 4*b*' and 4*b*'' of the secondary windings 3*b* and 4*b*.

Figure 6:
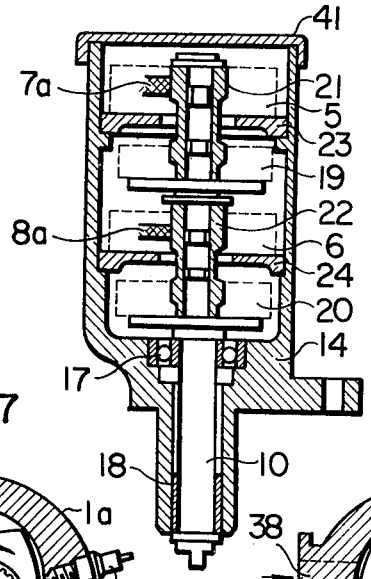
FIG. 6 is a longitudinal sectional view showing the construction of a circuit breaker used with the system of FIGS. 3 and 4.

Referring now to FIG. 6, the construction of the above circuit breakers 5 and 6 is described. Numeral 10 is a shaft of the circuit breakers which rotate in accordance with the engine and rotatably supported within a housing 14 by bearings 17 and 18. Cams 21 and 22 are moveably inserted in series with each other on the same axis and centrifugal advance mechanisms 19 and 20 are mounted to drive the cams 21 and 22 in accordance with the number of rotations of the engine. Numerals 23 and 24 are plates for mounting breaker arms 7*a* and 8*a*; stationary contacts 7*b* and 8*b* of the circuit breakers 5 and 6 and supported by the housing 14. Numeral 41 is a cap.

Figure 5:
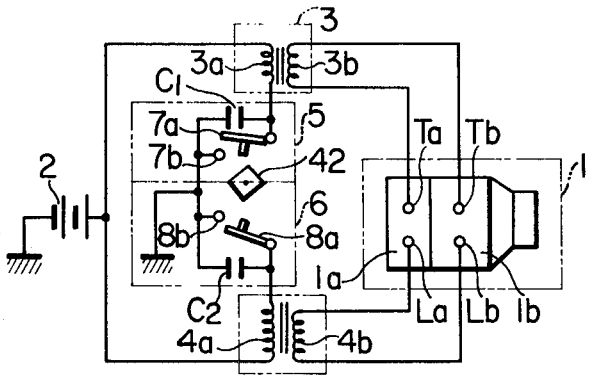

The circuit breakers 5 and 6 may use a common circuit breaker cam 42 instead of the above cam as shown in a fourth embodiment of FIG. 5. In this case, the breaker arms 7*a* and 8*a* are arranged opposite each other about the cam 42.

Figure 7:
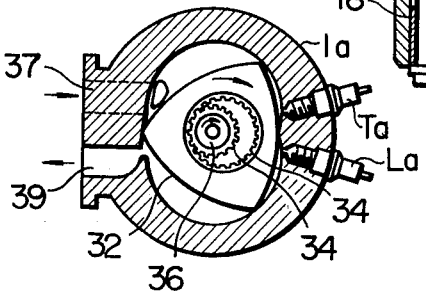
FIGS. 7 and 8 are sectional views showing the construction of the respective cylinders of a rotary engine.
Figure 8:
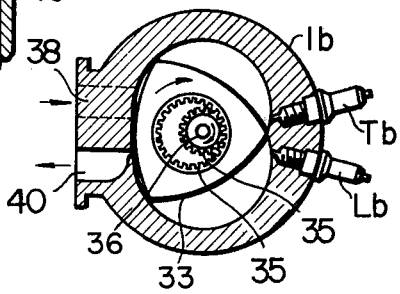

The internal construction of the rotary engine 1 is shown in FIGS. 7 and 8. The cylinders 1*a* and 1*b* respectively accommodate therein rotors 32 and 33 of regular triangular shape whose apexes are connected with curved lines and the rotation of the rotors 32 and 33 is increased three times by gear units 34 and 35 and transmitted to a common output shaft 36. Numerals 37 and 38 designate mixture intake ports and numerals 39 and 40 designate exhaust ports.

The above-described rotary engine 1 and the distributor assembly are associated with each other as follows. The rotors 32 and 33 are mechanically connected to the output shaft 36 in such a manner that the two rotors are angularly displaced from each other by 60° so that the distributor shafts 9 and 10 are rotated at a reduced speed, i.e., at half the speed of the output shaft 36. Therefore, the rotational speed ratio among the rotors 32, 33, the output shaft 36 and the distributor shafts 9, 10 is 2 : 6 : 3. On the compression stroke shown in FIG. 7, the contacts of the circuit breaker 6 are opened inducing a spark voltage in the secondary winding 4*b* of the ignition coil 4. This spark voltage is simultaneously applied to the spark plug L*a* of the first cylinder 1*a* and the spark plug L*b* of the second cylinder 1*b*. At this time, the first cylinder 1*a* is on the compression stroke and thus the mixture is burned and exploded causing the rotor 32 to produce a power. At this time, the second cylinder 1*b* is in the condition shown in FIG. 8, i.e., it is not on the compression stroke. Therefore, the high voltage applied to the spark plug L*b* is used wastefully and thus there is no ill effect on the engine 1. At a time delayed by about 0° to 50° of the output shaft 36 after the opening of the contacts of the circuit breaker 6, the contacts of the circuit breaker 5 are opened inducing a spark voltage in the secondary winding 3*b* of the ignition coil 3. At this time, as for FIG. 1 the distributor brush 11*a* is located opposite to the side electrode 11*a* connected to the spark plug T*a* of the first cylinder 1*a* and thus the spark voltage induced in the secondary winding 3*b* is applied to the spark plug T*a*. The combustion of the mixture in the first cylinder 1*a* is promoted by the ignition action of the spark plug T*a*.

On the other hand, in FIGS. 3, 4 and 5, the spark voltage is simultaneously applied to the spark plug T*a* of the first cylinder 1*a* and the spark plug T*b* of the second cylinder 1*b*. At this time, as mentioned above, the first cylinder 1*a* is on the compression stroke and thus the mixture is burned and exploded causing the rotor 32 to produce a power. At the same time, the second cylinder 1*b* is not on the compression stroke. Therefore the high voltage applied to the spark plug T*b* is used wastefully and thus there is no ill effect on the engine 1.

When, in this condition, the rotors 32 and 33 rotate 60° in the direction of the arrow, respectively, that is, when both of the distributor shafts 9 and 10 rotate 90°, the circuit breakers 6 and 5, in this order, reopen their respective contacts so that the high voltage is produced in the secondary windings 4*b* and 3*b* of the ignition coils 4 and 3 in this order and thus the high voltages are applied to the spark plugs L*a*, L*b* and T*a* in FIG. 1 and L*a*, L*b*, T*a* and T*b* in FIGS. 3, 4 and 5. At this time, the rotor 32 of the first cylinder 1*a* is in the position shown in FIG. 4, while the rotor 33 of the second cylinder 1*b* is in the position shown in FIG. 3. Consequently, only the second cylinder 1*b* produces a power. Thereafter, each time the rotors 32 and 33 rotate 60° in the direction of the respective arrow, the high voltage is applied to each of the spark plugs L*a* and L*b* and to either the spark plug T*a* or T*b* at a slightly delayed ignition time instant, thereby causing the rotors 32 and 33 to produce power alternately. This power is transmitted to the wheel, for example, which is provided with the output shaft 36 and which is not shown.

While, in the embodiment described above, the ignition signal generators comprise the circuit breakers 5 and 6, and the opening and closing of the respective breaker contacts are controlled respectively by the cams 21 and 22, it is of course possible to use ignition signal generators of the type which employs an inductor in place of the cam, and a magnet and a signal coil in place of the contacts, whereby the semiconductor switching elements such as transistors or thyristors connected in series with the primary windings of the ignition coils are controlled by the reshaped outputs of the ignition signal generators. Further, while, in the above-described embodiment, the two centrifugal advance mechanisms 19 and 20 and the two vacuum-advance devices 25 and 26 are employed to vary the ignition timing of the two ignition coils 3 and 4 in accordance with the number of revolutions of the engine and the intake manifold vacuum, it is possible to primarily set the ignition timing of either one of the ignition coils.

I claim:

1. An ignition system for a two-cylinder engine comprising a first ignition signal generator, a first ignition coil controlled by said first ignition signal generator, a first pair of spark plugs connected in series with said first ignition coil, a second ignition signal generator operable independently of said first ignition signal generator to generate ignition signals at time instants different from those of said first ignition signal generator, a second ignition coil controlled by said second ignition signal generator, a second pair of spark plugs connected in series with said second ignition coil, a first ignition time control means including a first centrifugal advance device operable in response to the number of rotations of the engine and a first vacuum advance device operable in response to an intake negative pressure, said first centrifugal advance device and said first vacuum advance device being coupled to said first ignition signal generator for varying the time of ignition signal generation by said first ignition signal generator in accordance with the number of rotations of the engine and the intake negative pressure, and second ignition time control means being adapted to operate entirely independent from said first ignition time control means and including a second centrifugal advance device operable in response to the number of rotations of the engine and a second vacuum advance device operable in response to the intake negative pressure, said second centrifugal advance device and said second vacuum advance device being coupled to said second ignition signal generator for independently varying the time of ignition signal generation by said second ignition signal generator in accordance with the number of rotations of the engine and the intake negative pressure.

2. An ignition system for a two-cylinder engine according to claim 1 further comprising a distributor having a distributor brush connected between said second ignition coil and said second pair of spark plugs.

3. An ignition system according to claim 2, wherein said first and second ignition signal generators and said distributor brush of said distributor are arranged on the same axis to form a distributor assembly.

4. An ignition system according to claim 1, wherein ignition coils comprise secondary windings consisted of two coil members whose common taps are grounded respectively and each of said coil members of said secondary windings is connected to each of ignition plugs respectively.

5. An ignition system according to claim 1, wherein each of said first and second ignition signal generators comprises a cam and movable arms actuated by said cam.

6. An ignition system according to claim 5, wherein said first and second ignition signal generators employ said cam in common.

7. An ignition system according to claim 1 further comprising a distributor assembly having a first shaft and a second shaft aligned along the same axis and mechanically coupled with each other integrally, said first and second shafts being associated with said first and second ignition signal generators respectively.

* * * * *